US005319379A

United States Patent [19]

Waken et al.

[11] Patent Number: 5,319,379

[45] Date of Patent: Jun. 7, 1994

[54] PARABOLIC DUAL REFLECTOR ANTENNA WITH OFFSET FEED

[75] Inventors: David R. Waken, Clearwater; Tyson S. Craven, Fort Lauderdale, both of Fla.

[73] Assignee: Hercules Defense Electronics Systems, Inc., Clearwater, Fla.

[21] Appl. No.: 643,910

[22] Filed: Aug. 24, 1984

[51] Int. Cl.[5] ..... H01Q 19/00

[52] U.S. Cl. ..... 343/756

[58] Field of Search ..... 343/872, 909, 910, 915, 343/756, 781 CA

[56] References Cited

U.S. PATENT DOCUMENTS 3,771,160 11/1973 Laverick ..... 343/756

*Primary Examiner*—Theodore M. Blum

*Attorney, Agent, or Firm*—Mark Goldberg

[57] ABSTRACT

A dual polarized mechanical scan antenna capable of rapid beam scanning includes a parabolic reflector having an elliptically shaped solid metal central section with conductive parallel grids extending therefrom to the perimeter of the paraboloid to form two outer grided sections. The axis of the parabolic reflector and the radiation axis of the feed antenna, positioned at the focus in alignment therewith, is positioned at a predetermined angle from a reference axis of the system. A polarization twist reflector is positioned at the focus for pivoting about the perpendicular to the reference axis. Dual polarization is realized when the twist plate is positioned such that the antenna system receives signals along paths that clear the parabolic reflector.

4 Claims, 2 Drawing Sheets

PARABOLIC DUAL REFLECTOR ANTENNA WITH OFFSET FEED

BACKGROUND OF THE INVENTION

1. Field of the Invention

The present invention relates to reflector type antennas and more particularly to doubly reflective antennas capable of rapid mechanical beam scanning.

2. Description of the Prior Art

Antennas capable of rapid mechanical beam scanning with the minimum of mechanical complexity while maintaining critical beam parameters throughout the scan limits was described in a paper entitled A Rapid Wide Angle Scanning Antenna with Minimum Beam Distortion, delivered by Martin and Swartzman at the Fifth Annual East Coast Conference on Aeronautical and Navigational Electronics in October 1958. Antennas of the type disclosed by Martin and Swartzman utilize an initially illuminated reflector constructed of grids parallel to the polarization vectors of the incident energy. Beams incident to the grided reflector are reflected therefrom to a flat deflecting plate pivotal about the antenna feed. This pivotal plate is constructed to provide a deflected beam having a polarization perpendicular to that of the polarization of the beam incident thereto. These polarization twisted signals propagate through the grided initial reflector into free space at an angle from the antenna axis that is determined by the angular position of the pivotal plate. Thus rapid mechanical scanning over wide scan angles with a minimum of beam distortion is provided. These antennas, however, are polarization sensitive, being operable only over a small range of polarization angles.

Applications exists that require a rapidly scanning dual polarized antenna capable of operating at both polarizations simultaneously. Many of these applications exhibit antenna requirements that vary with scan angle. During the search mode, the antenna of a guided missile seeker is positioned at a steep look-down angle (the angle of the radiation axis relative to the missile axis) and maximum system sensitivity is required, since the missile is at a great distance from the target.

Since signals reflected from targets illuminated at one polarization possess strong cross polarized components, to achieve this maximum sensitivity the antenna must receive both polarizations. During the track mode, the look-down angle is appreciably reduced and the missile is relatively close to the target permitting reception at a single polarization for reduced system sensitivity is acceptable.

SUMMARY OF THE INVENTION

The present invention discloses a scanning antenna which utilizes a parabolic reflector with a solid elliptically shaped central section positioned with its radiation axis off-set at an angle above the system's reference axis. Parallel grids extending from the perimeter of this solid central section to the perimeter of the paraboloid complete the reflector. A polarization twist reflector is positioned with its center at the focus of the composite parabolic reflector to reflect waves therebetween for coupling to a feed antenna positioned at the focus of the parabolic reflector with its radiation axis in substantial alignment with the axis. When the system operates with the antenna positioned for steep look down angles from the reference axis, rays of the wave reflected form the twist reflector do not pass through the grided section, thus permitting dual polarization operation of the antenna. At these angles substantially all of the beam energy is reflected between the twist reflector and the solid region of the parabolic reflector, and the antenna polarization is determined by the feed antenna polarization, which may be dual polarized.

As the beam scan angle approaches the reference axis, some rays of the wave reflected between the twist reflector and the parabolic reflector pass through a grided section and the antenna becomes polarization sensitive. In this situation the antenna exhibits a beamwidth for signals polarized parallel to the grids that is broader than the beamwidth for signals polarized perpendicular to the grids, since the antenna aperature for the parallel polarization has been decreased. Additionally, rays of the perpendicular polarized wave passing through the grided section are retarded relative to the rays of the wave free of the grids. This retardation disturbs the phase distribution across the aperture and increases the side lobe level of the antenna. Compensation for this retardation is provided by increasing the thickness of the radome enclosing the antenna in the region not covered by the parabolic reflector, to compensate for the retardation of the rays that pass through the grids.

Waves incident to the antenna from directions in the vicinity of the parabolic reflector axis realize significant aperture blockage due to the presence of the solid section. By virtue of the grided sections, large areas of the antenna aperture remain unblocked at the polarization perpendicular to the grids, and the antenna functions with reduced gain and increased side lobes. Thus, the sectioned parabolic reflector permits the antenna to operate over very wide scan angles with a significant region of dual polarization operability.

DESCRIPTION OF THE PREFERRED EMBODIMENTS

Figure 1:
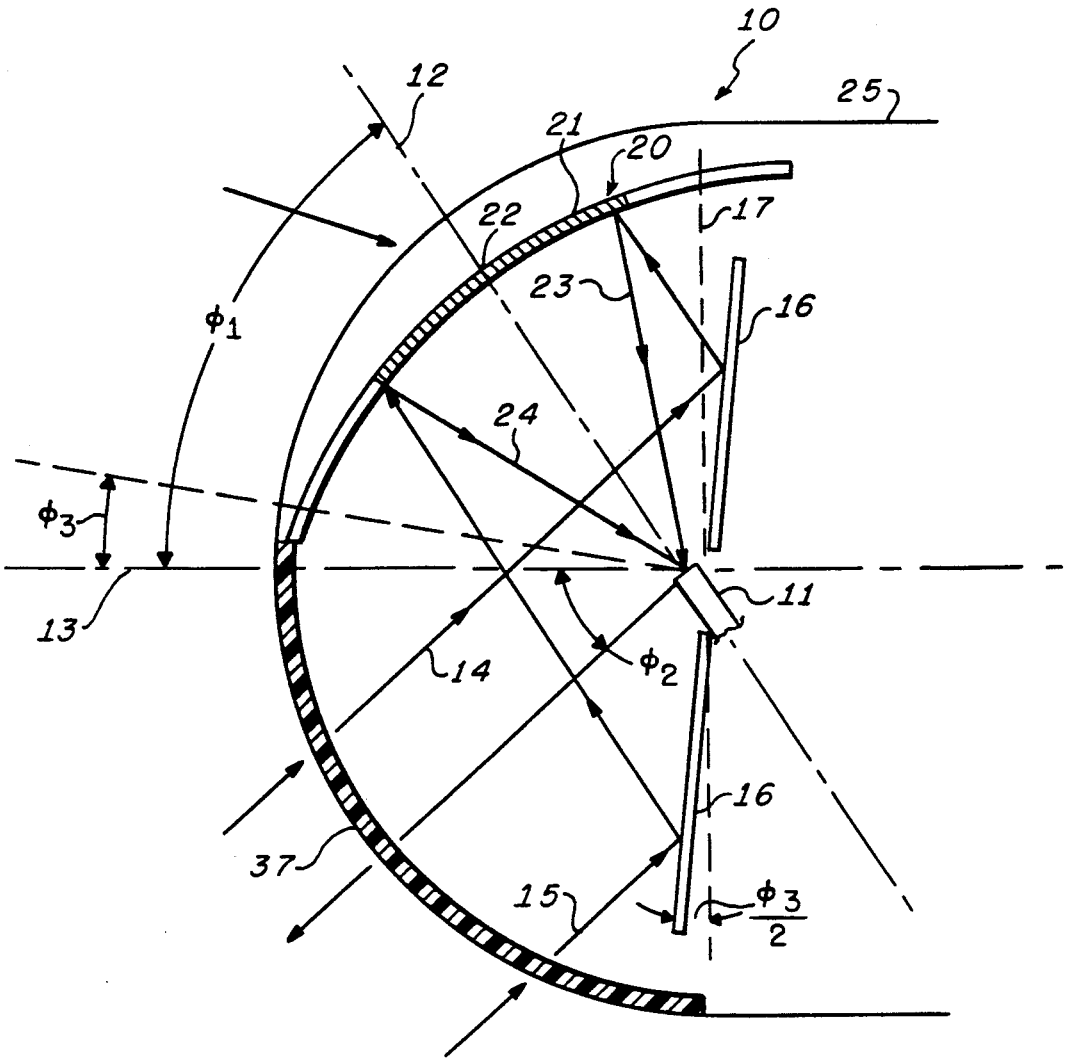
FIG. 1 is a cross sectional view of an embodiment of the invention showing ray paths thereon for a beam scanned at a steep depression angle.

A preferred embodiment of a dual polarized antenna capable of rapid mechanical scanning is shown in FIG. 1. Although the description of the antenna and its operation will be given with respect to a received plane wave, those skilled in the art will readily understand that the antenna is a reciprocal device and will operate in a similar fashion while transmitting. An antenna system 10 in accordance with the present invention may comprise a feed antenna 11 positioned with its radiation axis 12 rotated from a reference axis 13 by an angle $\phi_1$. A plane wave incident to the antenna system 10 at an angle of $\phi_2$, to the reference axis, provides signals along ray paths 14, 15 that are incident to a polarization rotating plate 16, rotated from the perpendicular 17 to the reference axis 13 by one-half the desired scan angle $\phi_3$, where the zero scan angle is 90°-$\phi$, from the perpendicular 17. The signals along rays 14 and 15 are reflected from the polarization rotating plate 16, after a 90° polarization rotation, towards a solid central section 21 of a parabolic reflector 20 having a radiation axis in substantial alignment with, and an apex 22 on the radiation axis 12 of the feed antenna 11.

The rotation angle $\phi_1$ of the radiation axis 12 from the reference axis 13 is chosen to cause signals along ray paths captured by the antenna system 10, over a selected range of incident angles $\phi_2$, to be reflected from the polarization twist plate 16 almost entirely to the solid metallic section 21 of the parabolic reflector 20 and therefrom along ray paths 23 and 24, to the feed 11. The signals along the ray paths within this selected angular range pass only through the radome 25 which may be spherically shaped with the center at the feed antenna 11, enclosing the parabolic reflector 20, feed antenna 11, and twist plate 16 and are deflected almost entirely to the solid metallic section 21 for focusing to the feed 11. Though these signals under go 90° polarization rotations when reflected from the twist plate 16 the solid metallic section 21 and the radome are polarization insensitive, thereby rendering the entire system insensitive to the receiver polarization and providing a dual polarized capability.

Figure 2:
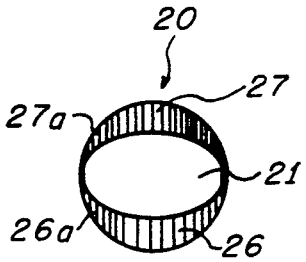
FIG. 2 is a view of the parabolic reflector of FIG. 1.

A head-on view of the composite parabolic reflector 20 is shown in FIG. 2. The solid central section 21 is shaped eliptically and the paraboloid is completed by upper 27 and lower 26 grided sections comprised of parallel grids 27*a* and 26*a* respectively.

Figure 3:
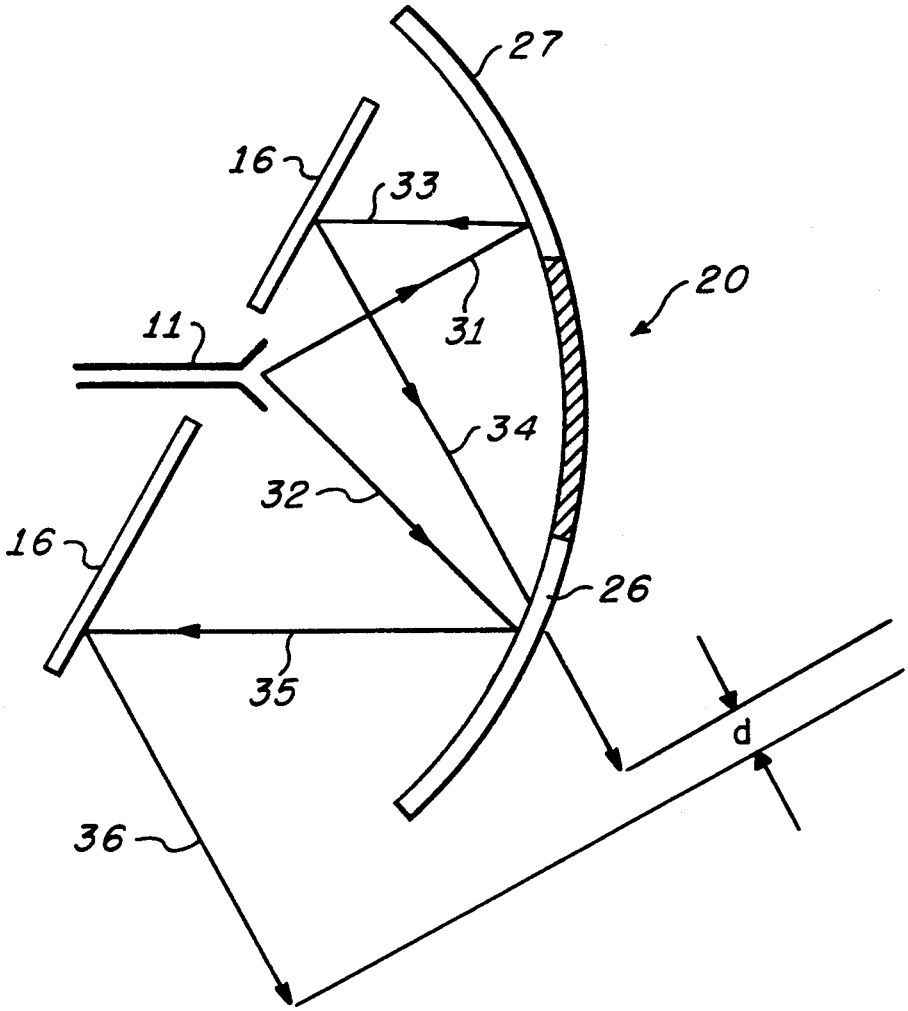
FIG. 3 is a cross sectional view of the embodiment of FIG. 1 at a beam scan angle wherefor a portion of the ray paths pass through the lower grided section of the parabolic reflector.

Plane waves incident to the antenna system forming a second group of angles with the reference axis that are smaller than the angles in the first group, may have ray paths that pass through the lower grided section and ray paths that do not. This situation is illustrated in FIG. 3 for a system during a wave transmission period. Signals along ray paths 31, 32 are incident from the feed antenna 11 to the parabolic reflector 20 with a polarization parallel to the rods in the grided sections 26, 27 and reflected therefrom to the polarization twist plate 16. The signal along ray path 31 is reflected from the grided section 27 to the polarization twist plate 16 and therefrom, with a polarization rotation of 90°, towards the grided section 26 along ray path 34. Since the polarization has been rotated by 90° this signal propagates through the grided section 26 for radiation into free space. The signal along ray path 32 is reflected from the grided section 26 along ray path 35 to the polarization twist plate 16 and therefrom along path 36 for radiation into free space without passing through the grided section 26. The signal along ray path 34 is retarded, relative to the signal propagating along path 36, in passing through the grided section 26 to establish a path length difference d. To compensate for this path length difference radome 25 is thickened, as for example by one-half wave length, in the region 37 that is entirely clear of the parabolic reflector 20, as shown in FIG. 1. This thickened portion of the radome retards signals passing therethrough relative to signals passing through other portions of the radome, thus compensating for the retardation of the signals that pass through the grided section 26. At this second range of angles the antenna is polarization sensitive, exhibiting a greater gain for signals with polarizations perpendicular to the grids in the grided sections 26, 27 than the gain for signals with polarizations that are parallel to these grids. This polarization sensitivity also provides a reduced overall gain for the system.

While the invention has been described in its preferred embodiments, it is to be understood that the words have been used are words of description rather than limitation and that changes may be made within the purview of the appended claims without departing from the true scope and spirit of the invention in its broader aspects.

We claim:

1. A beam scanning antenna comprising:

a parabolic reflector having a focus, an apex, an axis extending through said focus and said apex forming a reselcted angle with a reference axis, and a perimeter, said parabolic reflector including an elliptically shaped solid center of polarization insensitive reflecting material encompassing said apex and a plurality of cylindrically shaped reflecting grids parallelly positioned with predetermined spacings therebetween, each extending from said perimeter to said solid center;

a feed antenna positioned at said focus having a radiation axis in alignment with said parabolic reflector axis; and twist reflector means positioned to pivot about said focus for rotating polarizations of signals incident thereto through a predetermined angle and for scanning said beam through an angle $\phi$ when pivoted at said focus from a perpendicular to said reference axis by an angle $\phi/2$.

2. A beam scanning antenna in accordance with claim 1 wherein said predetermined angle is 90°.

3. A beam scanning antenna in accordance with claim 1 further including a radome positioned about said parabolic reflector, said feed antenna, and said twist reflector means, said radome having a thickened region that is clear of said parabolic reflector to establish path lengths through said thickened region that are greater than path lengths through other regions of said radome to provide compensation for phase delays cause by rays passing through said spacings between said grids of said parabolic reflector.

4. A beam scanning antenna in accordance with claim 3 wherein said thickened region provides path lengths one-half wave length greater than other regions of said radome.

* * * * *

UNITED STATES PATENT AND TRADEMARK OFFICE

CERTIFICATE OF CORRECTION

PATENT NO. : 5,319,379

DATED : June 7, 1994

INVENTOR(S) : David R. Wakeman and Tyson S. Craven

It is certified that error appears in the above-identified patent and that said Letters Patent is hereby corrected as shown below:

On title page, item [75]-the first inventor's name is incorrect. "David R. Waken" should read --David R. Wakeman--; and In the Claims, Col. 4, Claim 3, line 48, "cause" should read --caused--.

Signed and Sealed this

Sixth Day of September, 1994

*Attest:*

*Attesting Officer*

Bruce Lehman

BRUCE LEHMAN

*Commissioner of Patents and Trademarks*